US006382194B2

(12) United States Patent
Maeda

(10) Patent No.: US 6,382,194 B2
(45) Date of Patent: May 7, 2002

(54) MALFUNCTION-DETECTING DEVICE FOR EGR STEPPING MOTOR

(75) Inventor: Tetsuo Maeda, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/730,850

(22) Filed: Dec. 7, 2000

(30) Foreign Application Priority Data

Jun. 1, 2000 (JP) ..... 2000-164509

(51) Int. Cl.[7] ..... F02M 25/07; G01R 31/34

(52) U.S. Cl. ..... 123/568.16; 123/568.24; 701/108; 702/58; 702/183; 324/772

(58) Field of Search ..... 123/568.16, 568.23, 123/568.24; 701/108; 702/57, 58, 59, 64, 65, 183, 185; 324/545, 546, 713, 772

(56) References Cited

U.S. PATENT DOCUMENTS 4,690,120 A * 9/1987 Egle ..... 123/568.24
5,503,131 A * 4/1996 Ohuchi ..... 123/568.24
6,035,265 A * 3/2000 Dister et al. ..... 702/183

FOREIGN PATENT DOCUMENTS

JP 2639144 4/1997

* cited by examiner

*Primary Examiner*—Willis R. Wolfe
(74) *Attorney, Agent, or Firm*—Sughrue Mion, PLLC

(57) ABSTRACT

A malfunction-detecting-device for an EGR stepping motor is provided wherein a circuit structure is furthermore simple and also more detailed malfunction information can be obtained by detecting the malfunction of the stepping motor during initialization drive of the stepping motor when an engine is just started. In order to determine that excitation coils of the EGR stepping motor have wire breaks, a driving-signal monitoring circuit is provide for monitoring a voltage surge as a monitoring signal generated by turning off a switching element for driving each of the excitation coils so as to cause self induction in the excitation coil. Malfunction detecting means of the EGR stepping motor is also provided for counting the number of monitoring inputs to the driving-signal monitoring circuit during initialization driving of the EGR stepping motor so as to determine the presence of wire breaks in the excitation coils when the number counted is less than the number of times the coils are driven.

6 Claims, 10 Drawing Sheets

MALFUNCTION-DETECTING DEVICE FOR EGR STEPPING MOTOR

BACKGROUND OF THE INVENTION

1. Field of the Invention

The present invention relates to stepping motors for controlling an exhaust-gas-returning valve in an exhaust gas re-circulation system attached to an internal combustion engine, and in particular relates to a malfunction-detecting device for an EGR stepping motor, which detects the malfunction of the stepping motor.

2. Description of the Related Art

Hitherto, as pollution control in automobile exhaust gas, an exhaust gas re-circulation (EGR) system is known for reducing nitrogen oxides ($NO_x$) in exhaust gas of an internal combustion engine. In the EGR system, a part of exhaust gas is returned from an exhaust gas passage to an intake passage via an exhaust gas returning passage connecting the exhaust gas passage to the intake passage of the internal combustion engine so as to be re-circulated in fuel mixture to be sucked into the engine, so that the heat due to the combustion in the engine cylinder is absorbed by the inert gas in the exhaust gas so as to reduce the maximum combustion temperature, thereby reducing $NO_x$.

However, the re-circulation of exhaust gas causes reduction in the output of the engine and instability in combustion, resulting in problems of deteriorated operationality and increased hydrocarbons (HC). Therefore, the re-circulating amount of the exhaust gas must be suitably controlled according to operational conditions so as to reduce the problems. For that purpose, an exhaust gas returning valve (EGR valve) is provided in an exhaust gas returning passage and the amount of the valve opening (opening area) is controlled. The EGR valve is conventionally controlled by using a stepping motor (EGR stepping motor) in general, because in the EGR stepping motor, digital control of closed loop can be performed; positional control is excellent; accumulated errors are small. A valve opening adjusting structure in that a valve disc is ascended or descended by the rotation of the stepping motor rotor is known.

FIG. 7 is a schematic illustration showing an overall structure of a commonly used internal combustion engine. In FIG. 7, an air flow sensor (AFS) 2 measures the amount of air sucked into an engine 1 which is an internal combustion engine; a throttle valve 3 adjusts the amount of air sucked into the engine 1 by operation linked to an accelerator pedal (not shown) which is generally operated by a driver; a throttle valve opening sensor 4 detects the position of the throttle valve 3; a clank angel sensor 5 detects the rotational speed and the position of a clank shaft of the engine 1; a water temperature sensor 6 detects the temperature of cooling water 1*a* as means for detecting warming up conditions of the engine 1; an $O_2$ sensor 7 detects the concentration of oxygen in the exhaust gas exhausted from the engine 1; and a cylinder identifying sensor 13 identifies a combustion cylinder attached to a cam shaft.

An engine controller 8 determines operational conditions of the engine by receiving information from the above-mentioned various sensors arranged in each position of the engine 1 and performs the computation of various controlled variables according to the operational conditions, thereby burn fuel in a desired air-fuel ratio. An air by-pass valve 10 controls an air reservoir by-passing the throttle valve 3 and performs the rotational speed control of the engine during the idling when the throttle valve 3 is perfectly closed and the torque control during the running. An injector 11 supplies fuel to the engine 1.

An exhaust gas returning passage 23 is the EGR system for returning the exhaust gas exhausted from the engine 1 again to a combustion chamber in the engine 1 so as to burn it again by connecting an exhaust gas passage 22 to an intake passage 21. An EGR valve 12 is arranged in the exhaust gas returning passage 23 for controlling the amount of the EGR to be burnt again. A sparking plug 9, the air by-pass valve 10, the injector 11, and the EGR valve 12 are controlled by the engine controller 8.

FIG. 8 is a sectional view showing an example of an EGR valve structure. As shown in the drawing, the EGR valve 12 comprises a stepping motor 12*a* and a valve disc 12*b*. The stepping motor 12*a* comprises a stator 121 and a rotor 122 while the valve disc 12*b* comprises a valve 123 and a rod 124 having the valve 123 at one end affixed thereto and being vertically movable when viewed in the drawing. The exhaust gas flows into an entrance port 125 from the exhaust gas passage 22 and flows out of an exit port 126 toward the intake passage 21. These ports 125 and 126 form parts of the exhaust gas returning passage 23.

When the rotor 122 is rotated by a driving signal to the stepping motor 12*a*, the rotation is converted into rectilinear motion by a screw 127 to be transmitted to a motor shaft 128. At this time, when the rotation of the stepping motor 12*a* is the normal direction, the motor shaft 128 moves the rod 124 upwardly when viewed in the drawing against a spring force of a spring 129 so that the valve 123 is moved in the separating direction from a seat member 130, thereby opening the EGR valve. On the other hand, when the rotation is the reverse direction, the motor shaft 128 moves the rod 124 downwardly in corroboration of a spring force of the spring 129 so that the valve 123 is moved in the approaching direction toward the seat member 130, thereby closing the EGR valve.

FIG. 9 shows a schematic connection diagram of a conventional malfunction-detecting device for the EGR stepping motor disclosed in Japanese Unexamined Patent Application Publication No. 3-203599, for example. In FIG. 9, a microcomputer 80 corresponds to the engine controller 8; a motor driving circuit 81 drives the stepping motor 12*a* of the EGR valve 12. In a break detecting circuit 82, transistors Tr1 to Tr4 are driving and detecting breaks; grounding resistances R1 to R4 are grounding emitters of the transistors; excitation coils S1 to S4 are the stator 121 of the stepping motor 12*a*; numerals C1 to C4 denotes comparators; potential dividing resistors R5 and R6 are dividing a power supply voltage $V_c$; numerals 511 to 514 denote delay circuits; numerals 521 to 424 denote D type flip-flop circuits; and numeral 53 denotes an AND circuit.

In the circuit of the conventional malfunction-detecting device for the EGR stepping motor shown in FIG. 9, when driving signals (symmetrical square-waves) having four phases being 90° out of phase with each other are supplied to each base of the transistors Tr1 to Tr4 from the motor driving circuit 81, as shown in FIG. 10, the transistors Tr1 to Tr4 are turned on during the base input signal is in the high ("H") level while are turned off during the low ("L") level. When the transistor Tr1 is turned on, the excitation coil S1 is electrically excited while a non-inversion input terminal of a comparator C1 is to be the high ("H") level by a voltage drop due to the resistor R1. To the non-inversion input terminal of the comparator C1, a dividing voltage due to the potential dividing resistors R5 and R6 is applied; since the voltage generated in both ends of the resistor R1 by the current flowing through the resistor R1 is set to be higher than the dividing voltage, the output voltage of the comparator C1 is to be the high ("H") level.

On the other hand, during the off of the transistor Tr1, the above-mentioned current does not pass through the excitation coil S1 and the resistor R1 so that the input voltage of the non-inversion input terminal of the comparator C1 is to be lower than the above-mentioned dividing voltage, thereby the output voltage of the comparator C1 is to be the low ("L") level. As for the other transistors Tr2 to Tr4, the same operations are performed. The outputs of the comparators C1 to C4 are shown in FIG. 10 (broken lines show breaks).

The output voltages of the comparators C1 to C4 are applied to data input terminals of flip-flops 521 to 524; thereupon delayed for a predetermined time "τ" by delay circuits 511 to 514; and latched at the time of inputting in the rising edge of the driving signals to be input to trigger terminals T1 to T4. Since the above-mentioned predetermined time "τ" is set so that the rising edge positions of the input driving signals of the trigger terminals T1 to T4 are to be the high ("H") level period of the input voltages (output voltage of the comparators C1 to C4) in the data input terminals of the D type flip-flops 521 to 524, all the output signals of each output terminal "Q" of the D type flip-flops 521 to 524 are to be the high ("H") level, in the normal period. Therefore, the high ("H") level signal is normally extracted from an AND circuit 53.

When a break is assumed to be generated in the excitation coil S3, even when the driving signal of the high ("H") level is supplied to the base of the transistor Tr3, the current, which has to pass through the collector of the transistor Tr3 via a resistor R7 and the excitation coil S3, does not flow therethrough so that the transistor Tr3 remains as off, thereby the output voltage of the comparator C3 is to be the low ("L") level in the period of being originally the high ("H") level as shown by broken lines in C3 in FIG. 10. Therefore, only the output signal of the D type flip-flop 523 in output signals of the D type flip-flops 521 to 524 is to be the low ("L") level at the rising time t1 of the input driving signal T3, thereby the output signal of the AND circuit 53 in the low ("L") level is input into the microcomputer 80 as a break detecting signal.

The conventional EGR malfunction-detecting device formed as mentioned above is complicated in the circuit structure, comprising comparators, delay circuits, D flip-flops, and the AND circuit. The malfunction-detecting is performed along with the operation of an internal combustion engine; the operational speed of the stepping motor is high during the operation of the internal combustion engine, so that when trying to obtain furthermore detailed information, only the presence of wire breaks, etc., in the excitation coil or the wiring of the stepping motor can be detected because of an extremely small pitch of the detected signal, thereby there has been a problem that the furthermore detailed information cannot be obtained.

SUMMARY OF THE INVENTION

In order to solve the above-mentioned problems, it is an object of the present invention to provide a malfunction-detecting device for an EGR stepping motor wherein a circuit structure is furthermore simple and also more detailed malfunction information can be obtained by detecting the malfunction of the stepping motor during initialization drive of the stepping motor when an engine is just started.

In view of the above-mentioned object, in accordance with the present invention, a malfunction-detecting device for an EGR stepping motor comprises a driving-signal monitoring circuit which monitors a voltage surge as a monitoring signal, wherein in order to determine the presence of wire breaks in excitation coils of the EGR stepping motor, the voltage surge is generated by turning off a switching element for driving each of the excitation coils so as to cause self induction in the excitation coil.

A malfunction-detecting device may further comprise malfunction detecting means of the EGR stepping motor for counting the number of monitoring inputs to the driving-signal monitoring circuit during initialization driving of the EGR stepping motor so as to determine the presence of wire breaks in the excitation coils when the number counted is less than the number of times the coils are driven.

Preferably, the malfunction detecting means of the EGR stepping motor determines the number of phases having wire breaks in the excitation coils by the number of counts of the monitoring inputs to the driving-signal monitoring circuit during the initialization driving.

Preferably, the malfunction detecting means of the EGR stepping motor comprises: initialization driving detecting means for detecting that an EGR valve is undergoing initialization driving; driving-pattern change detecting means for detecting a change in the driving pattern of the EGR valve; monitor input detecting means for detecting the monitor input from the driving-signal monitoring circuit; count addition means for adding one count for every monitor input while repeating the above-mentioned detection by the initialization driving detecting means, the driving-pattern change detecting means, and the monitor input detecting means until completion of the initialization; and malfunction state determining means for determining whether the excitation coils are normal and if not normal, the number of phases having wire breaks therein by classifying counted values in association with the number of phases of the stepping motor.

A malfunction-detecting device may further comprise malfunction detecting means of the EGR stepping motor for detecting wire breaks in the EGR stepping motor by recognizing that a monitor input of driving signals is not input in the preceding driving state when the EGR stepping motor is stopped after it was driven corresponding to operational conditions of an engine.

A malfunction-detecting device may further comprise: initialization-completion detecting means for detecting that initialization of an EGR valve has been completed; monitor input memorizing means for memorizing monitor input when the monitor input was generated by the driving of the EGR valve corresponding to operational conditions of an engine; driving-completion detecting means for detecting completion of driving of the EGR valve when it was driven; driving-stop detecting means for detecting a predetermined time elapsed after stopping of the EGR valve; monitor input detecting means for detecting whether monitor input is generated to the driving-signal monitoring circuit; and malfunction determining means for determining whether the excitation coils are normal or have wire breaks by examining the presence of the monitor input.

DESCRIPTION OF THE PREFERRED EMBODIMENTS

Figure 1:
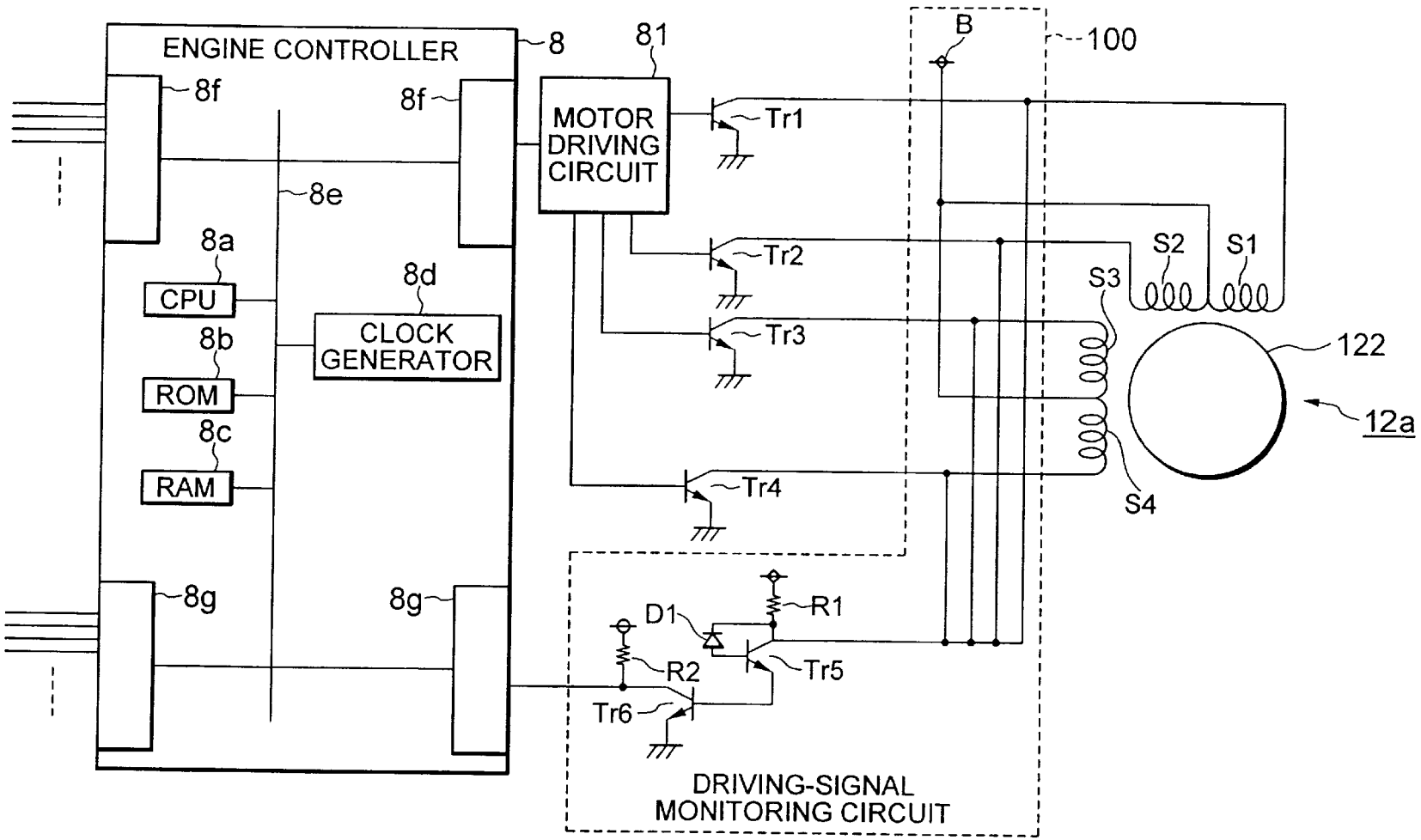
FIG. 1 is a connection diagram of an example of a malfunction-detecting device for an EGR stepping motor according to the present invention.

FIG. 1 shows an example of a malfunction-detecting device for an EGR stepping motor according to the present invention. The malfunction-detecting device for the EGR stepping motor according to the present invention comprises a monitoring circuit 100 for monitoring driving signals, which is a piece of hardware, and malfunction detecting means 803 of the stepping motor for detecting a malfunction from the output of the driving-signal monitoring circuit 100. The malfunction detecting means 803 is described later by referring to FIG. 3, etc., and is disposed in an engine controller 8 operating according to a program. In addition, the overall structure of an internal combustion engine and the structure of an EGR valve are basically the same as those shown in FIGS. 7 and 8, respectively.

As shown in FIG. 1, the driving-signal monitoring circuit 100 is formed of a PNP transistor Tr5, an NPN transistor Tr6, an emitter pull-up resistor R1 of the PNP transistor Tr5, a diode D1 connected between the base and the emitter of the PNP transistor Tr5, and a collector pull-up resistor R2 of the NPN transistor Tr6.

NPN transistors Tr1, Tr2, Tr3, and Tr4 as elements for driving excitation coils S1, S2, S3, and S4, respectively, have the collectors thereof connected to ends of the excitation coils S1, S2, S3, and S4 of a stepping motor 12*a*, the emitters grounded thereof, and the bases thereof connected to an output port 8*f* of the engine controller 8 via the motor driving circuit 81. The collectors of the NPN transistors Tr1, Tr2, Tr3, and Tr4 are also connected to the emitter of the PNP transistor Tr5; the emitter of the PNP transistor Tr5 is pulled up to a battery power supply via the emitter resistor R1; the base of the PNP transistor Tr5 is connected to the emitter thereof via the diode D1; and the collector thereof is connected to the base of the NPN transistors Tr6.

The emitter of the NPN transistor Tr6 is grounded while the collector thereof is pulled up to 5 V via the pull-up resistor R2 so as to supply the monitored signal to an input port 8*g* of the engine controller 8.

The engine controller 8 is provided with a CPU 8*a*, a ROM 8*b* storing processing programs or data, a RAM 8*c* used as an operating region, and a clock generator 8*d* supplying a master clock to the CPU 8*a*. These units are connected together via a bilateral bus line 8*e* and each is connected to the output port 8*f* and the input port 8*g*.

Figure 3:
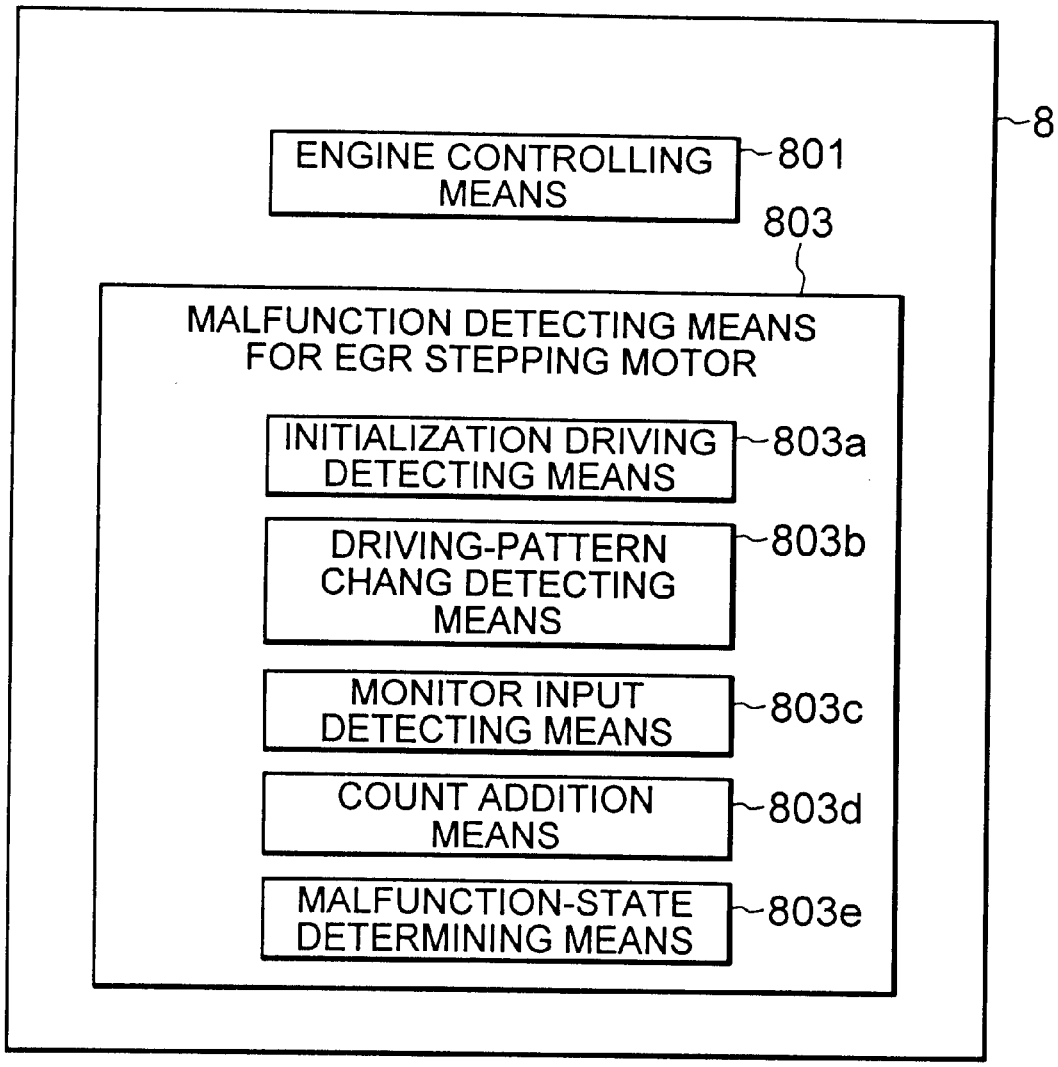
FIG. 3 is a functional block diagram of an engine controller 8 according to a first embodiment of the present invention shown in FIG. 1.
Figure 5:
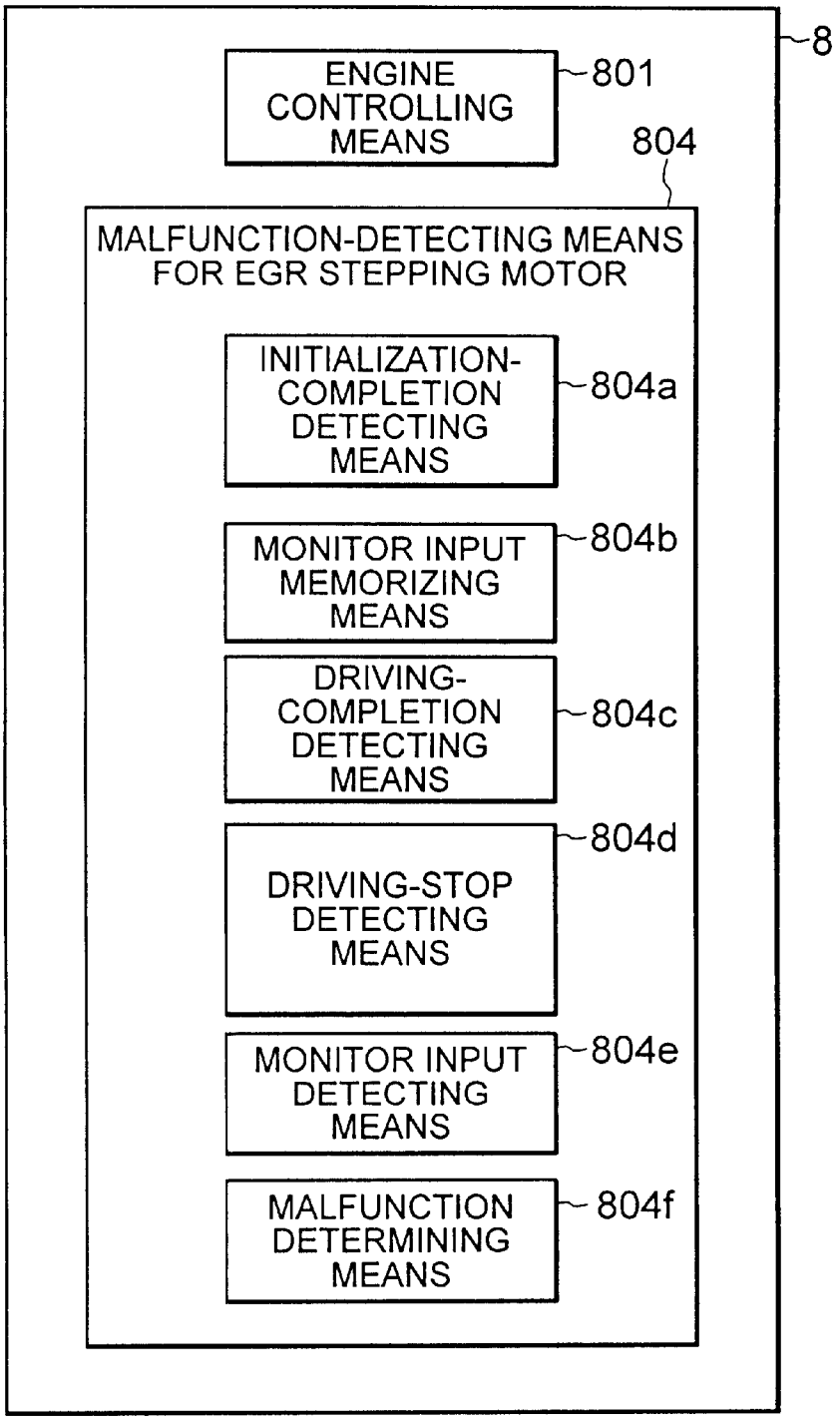
FIG. 5 is a functional block diagram of an engine controller 8 according to a second embodiment of the present invention shown in FIG. 1.
Figure 7:
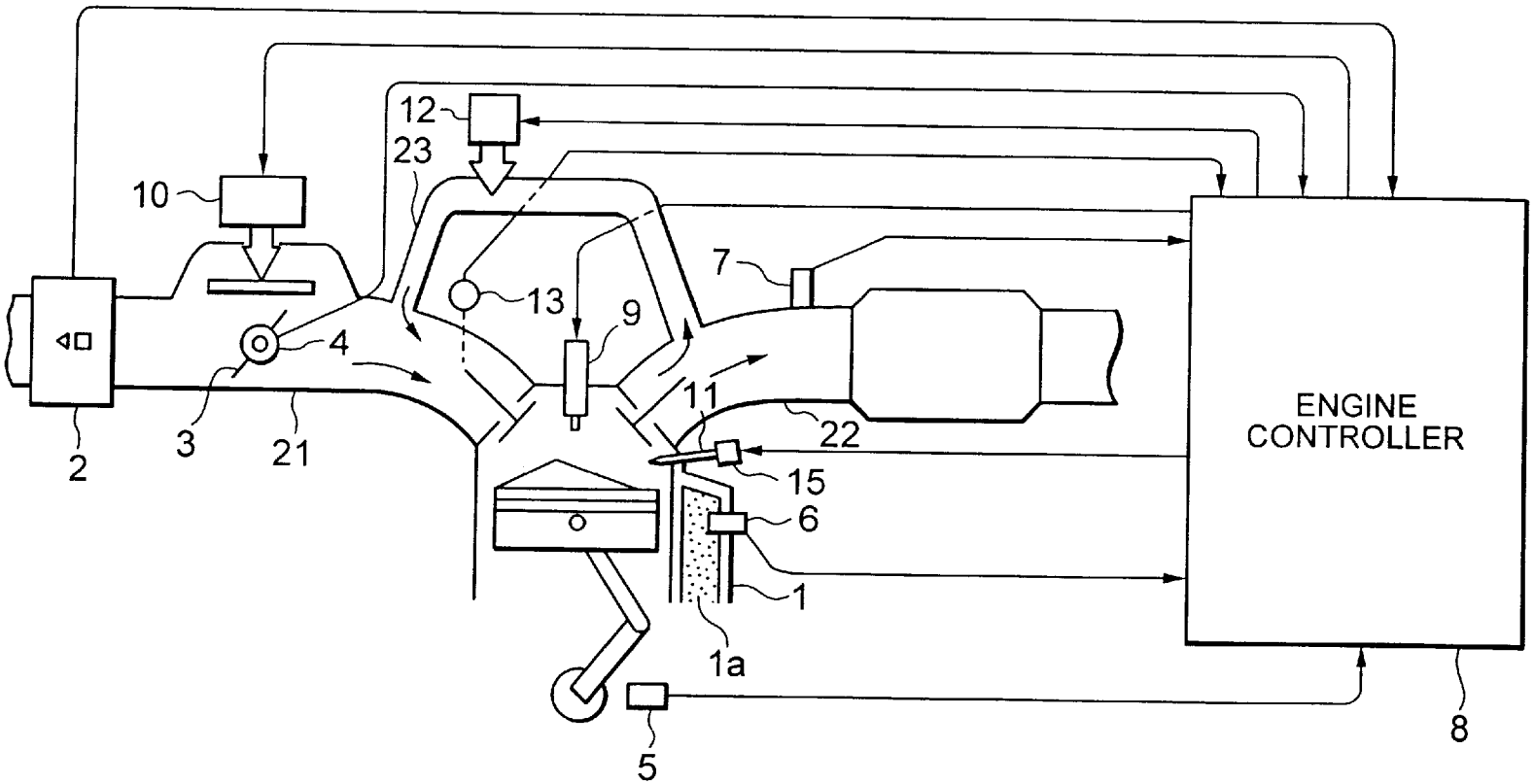
FIG. 7 is a schematic illustration showing an overall structure of a commonly used internal combustion engine.

As shown in FIG. 7, the engine controller 8 determines the operating conditions of the engine 1 by the information input via the input port 8*g* from sensors such as an AFS 2, a throttle valve opening sensor 4, a clank angle sensor 5, the water temperature sensor 6, an $O_2$ sensor 7, and a cylinder identifying sensor 13, and outputs driving signals of the ignition plug 9, the air by-pass valve 10, an injector 11, and an EGR valve 12 via respective driving circuits (not shown) so as to perform common engine control (by engine controlling means 801 shown in FIGS. 3 and 5).

Figure 2:
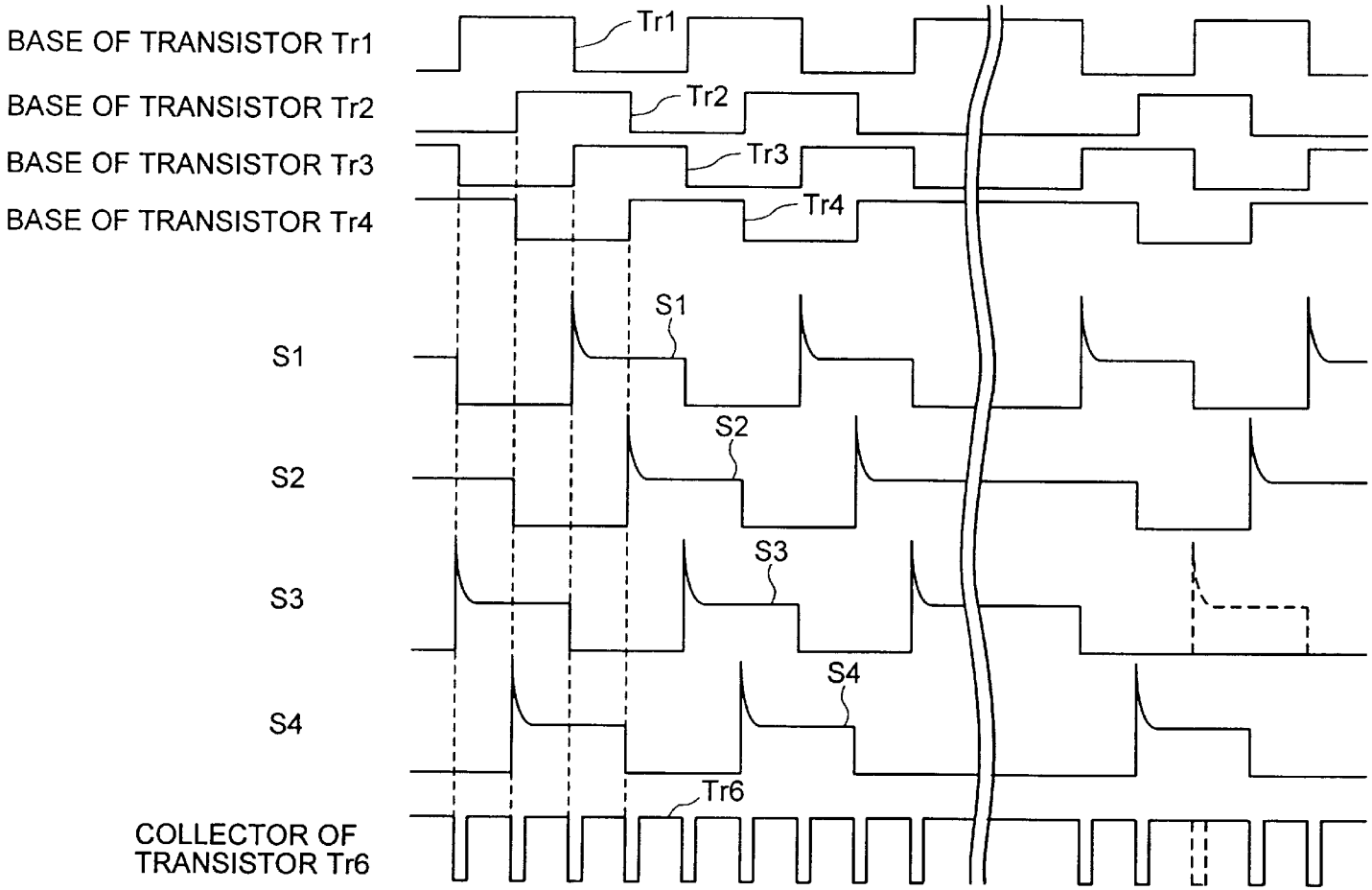
FIG. 2 is an operational timing chart for illustrating operations of pieces of hardware shown in FIG. 1.

FIG. 2 shows an operational timing chart for illustrating operations of the pieces of hardware shown in FIG. 1.

First Embodiment

Figure 4:
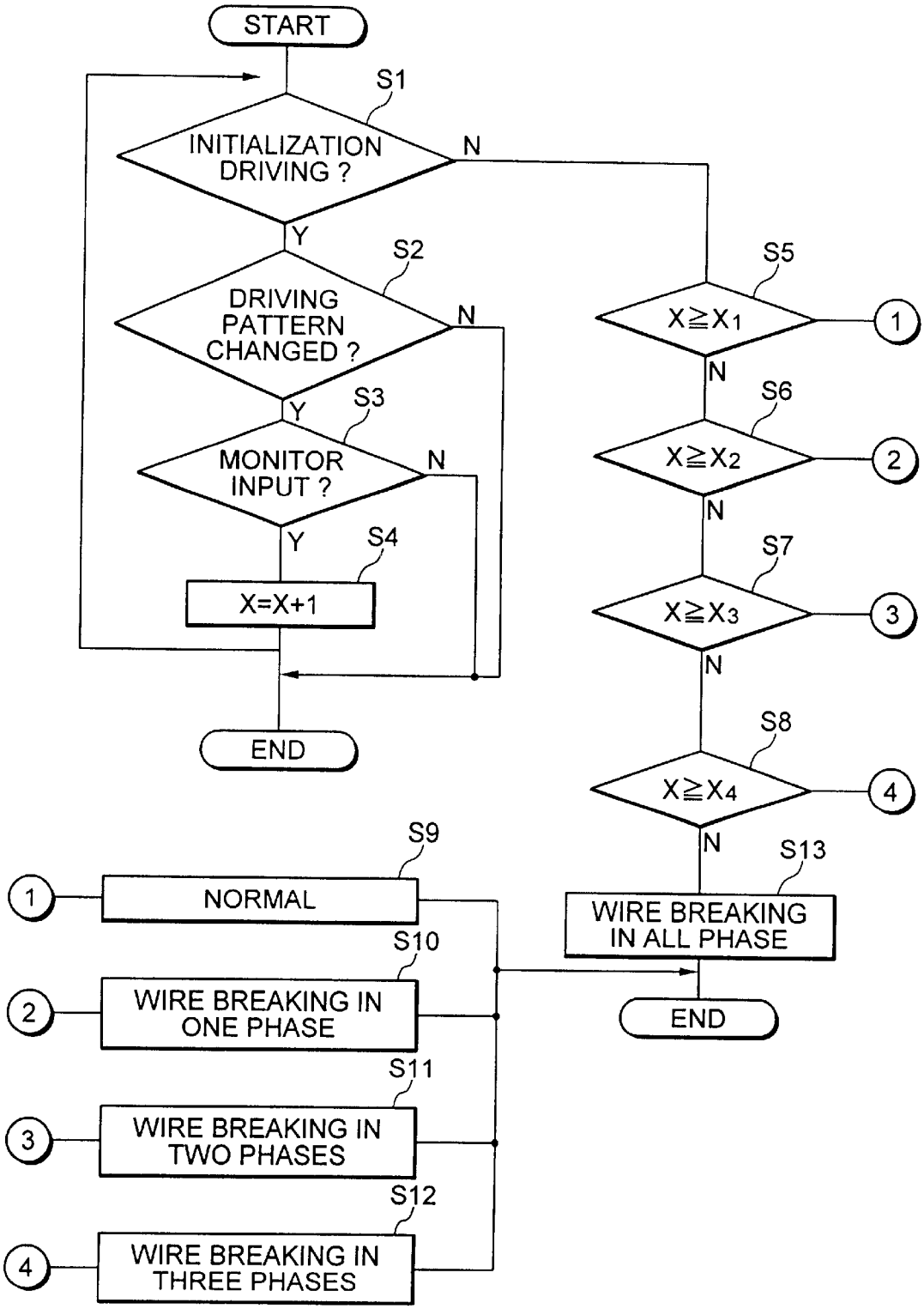
FIG. 4 is an operational flow-chart of malfunction detecting means for the EGR stepping motor of the engine controller 8 shown in FIG. 3.

Next, a malfunction-detecting device for an EGR stepping motor according to a first embodiment of the present invention will be described. FIG. 3 shows a functional block diagram of the engine controller 8 according to the embodiment shown in FIG. 1, and FIG. 4 shows an operational flow-chart of the malfunction-detecting means 803 for the EGR stepping motor of the engine controller 8 shown in FIG. 3.

Since the operational speed of the stepping motor is high during the operation of the internal combustion engine, the signal from the driving-signal monitoring circuit 100 cannot be precisely monitored because of its extremely small pitch. Therefore, in this embodiment, the malfunction detecting of the EGR stepping motor 12*a* is carried out during the initialization of the EGR valve 12 which is performed when the engine is started. For example, while the period of the output signal from the transistor Tr6 shown in FIG. 2 is 5 ms, the period of the output of the transistor Tr6 during the initialization of the EGR valve 12 is larger, namely 20 ms.

Figure 8:
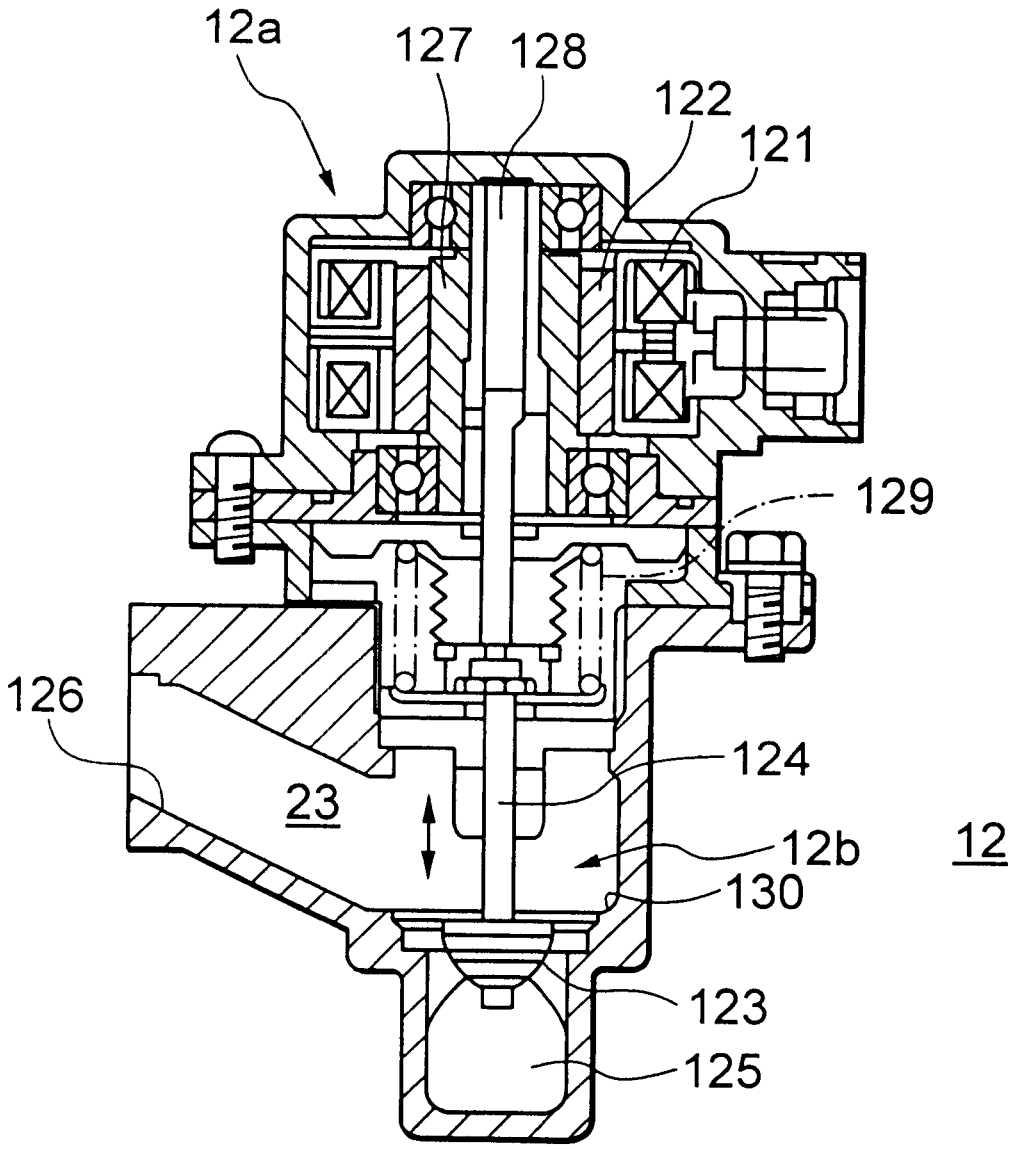
FIG. 8 is a sectional view showing an example of an EGR valve structure.
Figure 9:
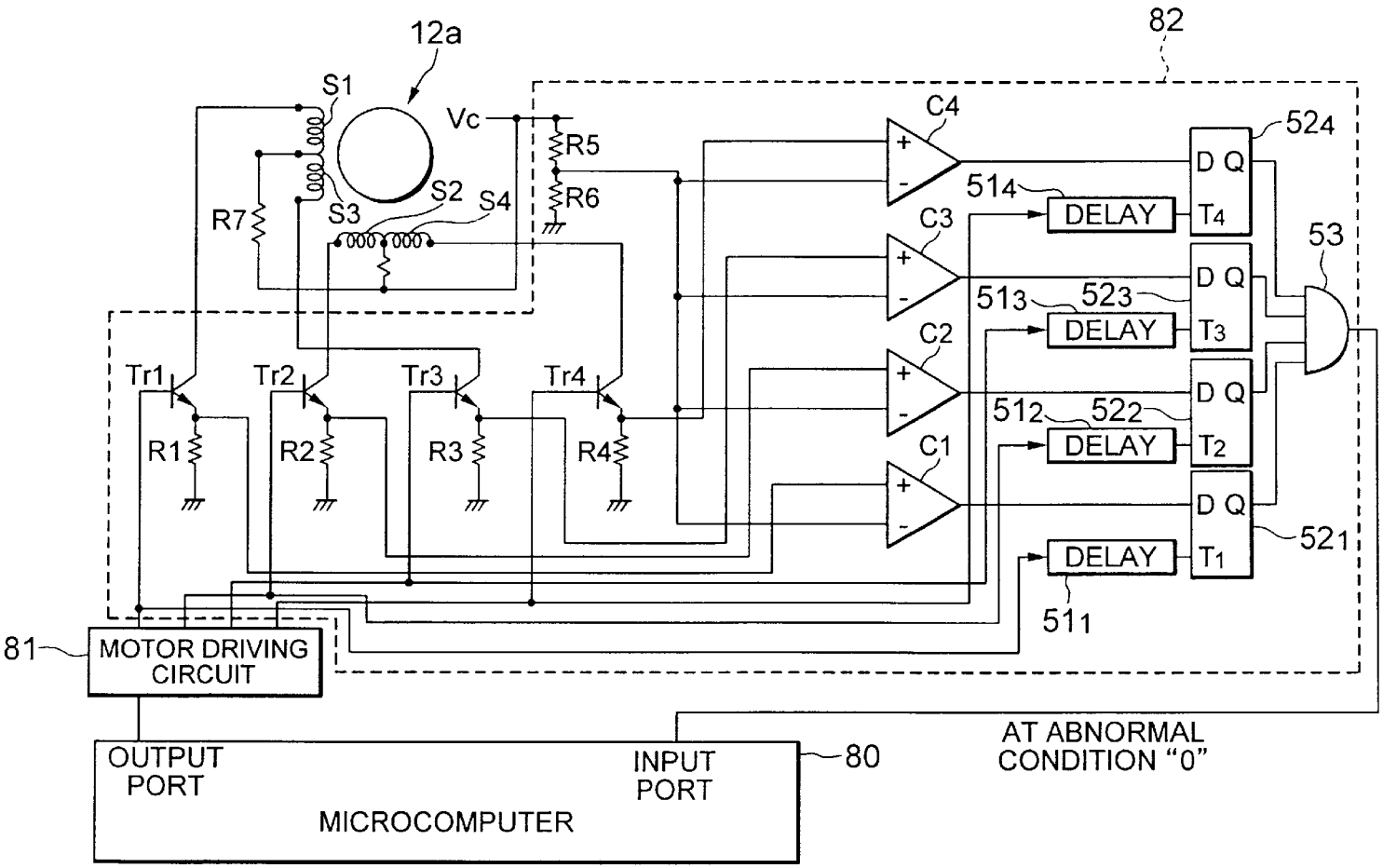
FIG. 9 is a schematic connection diagram of a conventional malfunction-detecting device for the EGR stepping motor.
Figure 10:
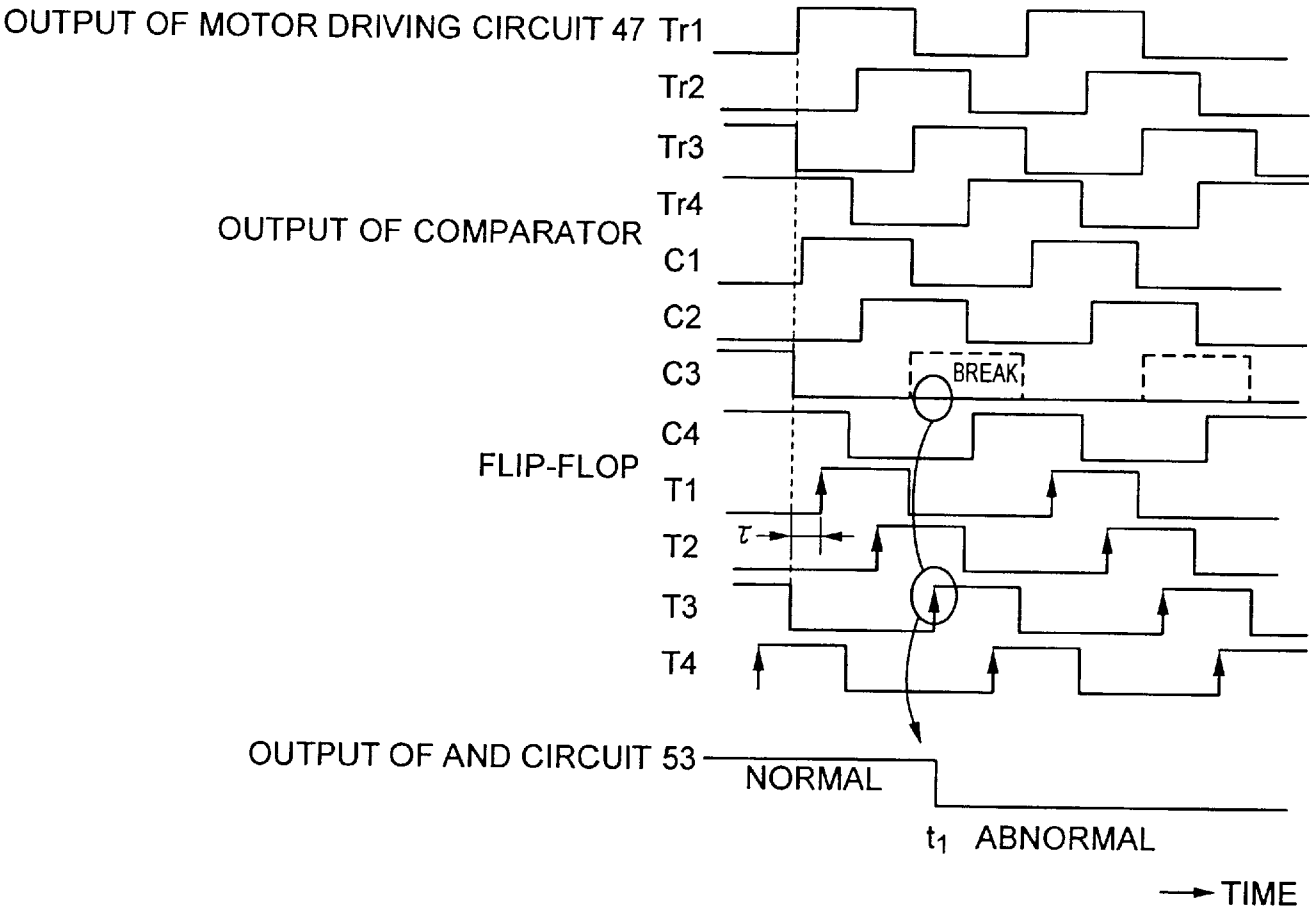
FIG. 10 is an operational timing chart illustrating the operations of the connection shown in FIG. 9.

The initialization is performed by controlling rising and falling of the valve 123 shown in FIG. 8 relative to a fiducial position, which is set by tightly touching the valve 123 to the sheet member 130 so as to be fully closed for controlling the valve thereafter. Therefore, since the position of the valve 123 is not accurately known when the engine was last stopped, in the initialization, a predetermined number of signals is generated for moving the valve 123 at a full stroke so as to become fully closed even when it was fully opened. The predetermined number is determined by the number of steps between the fully opened and the fully closed state of the EGR stepping motor 12*a*. The description will be made below with, for example, 60 steps between the fully opened and the fully closed state.

First, operations of the hardware circuits shown in FIG. 1 will be described. When driving signals (symmetrical square-waves) having four phases being 90° out of phase with each other, as shown by signals of transistors Tr1 to Tr4 in FIG. 2, are supplied to each base of the transistors Tr1 to Tr4 from the engine controller 8, the transistors Tr1 to Tr4 are turned on during the high ("H") level of the base input signals and are turned off during the low ("L") level. When the transistor Tr1 is on, the current passes from a battery "B" through the excitation coil S1, the collector of the transistor Tr1, and the emitter thereof, in this order, thereby electrically exciting the excitation coil S1. When the current through the excitation coil S1 is stopped by turning off the transistor Tr1, the transistor Tr5 is turned on by the generation of a high voltage (a voltage surge) due to the self induction of the coil, the transistor Tr6 is turned on, and the collector voltage of the transistor Tr6, which is input to the input port 8*g* of the engine controller 8, becomes the low ("L") level as shown by the signal of the transistor Tr6 in FIG. 2. The low ("L") level signal shown by the signal of the transistor Tr6 due to the surge is input to the engine controller 8 as a monitoring signal.

The operation of the transistors Tr2 to Tr4 is the same, and when none of the excitation coils S1 to S4 have broken wires, the signal of the transistor Tr6 shown in FIG. 2 is an equally spaced pulse signal. However, when a break occurs in, for example, the excitation coil S3, a pulse of the signal of the transistor Tr6 associated with the excitation coil S3 is omitted, as shown by broken lines in FIG. 2, at intervals of, for example, four pulses.

Next, the malfunction detecting means 803 for the EGR stepping motor of the engine controller 8 shown in FIG. 3 will be described with reference to FIGS. 3 and 4. In addition, engine controlling means 801 is the same as the common technique described in the Description of the Related Art. In the malfunction detecting means 803 for the EGR stepping motor, first, it is confirmed whether the EGR valve 12 is undergoing in the initialization driving at Step S1 in FIG. 4, (initialization driving detecting means 803*a* shown in FIG. 3). At Step S2, it is confirmed whether the driving pattern of the EGR valve 12 is changed (driving-pattern change detecting means 803*b*). It is confirmed at Step S3 whether the monitor input from the driving-signal monitoring circuit 100 exists (monitor input detecting means 803*c*); and when the monitor input is confirmed at Step S3, one is added to a counter X at Step S4 (count addition means 803*d*). The above-mentioned Steps S1 to S4 are repeated until initialization completion is confirmed at Step S1.

Then in Steps S5 to S8, the value of the counter X is classified. In this embodiment, the four-phase stepping motor 12*a* having 60 steps from the fully opened to the fully closed state is exemplified, so that X 1=60, X 2=60×75%=45, X 3=60×50%=30, and X 4=60×25%=15 are defined so as to determine the value of the requested X. That is, when the value is greater than or equal to 60, it is determined to be normal at Step 9; when the value is greater than or equal to 45 (45 to 59), a break in one phase is determined at Step S10, when the value is greater than or equal to 30 (30 to 44), breaks in two phases are determined at Step S11, when the value is greater than or equal to 15 (15 to 29), breaks in three phases are determined at Step S12, and when the value is less than 15 (0 to 14) at Step S8, breaks in all phases are determined at Step S13 (malfunction state determining means 803*e*).

In addition, the initialization driving state in the initialization driving detecting means 803*a* and the changed state of the driving pattern in the change detecting means for the driving pattern 803*b* can be obtained from the common controlling information of the entire engine (for example, the controlling command or signal to the EGR valve 12) generated by the engine controlling means 801 (see FIG. 3).

In addition, in the above-mentioned embodiment, the monitored value of the counter X is classified; however, when desired, it may be simply determined to be normal when the value is greater or equal to a predetermined value, which is number of times the coils are driven, and breaking is determined when the value is less than the predetermined value, at Step S5 shown in FIG. 4.

Second Embodiment

Figure 6:
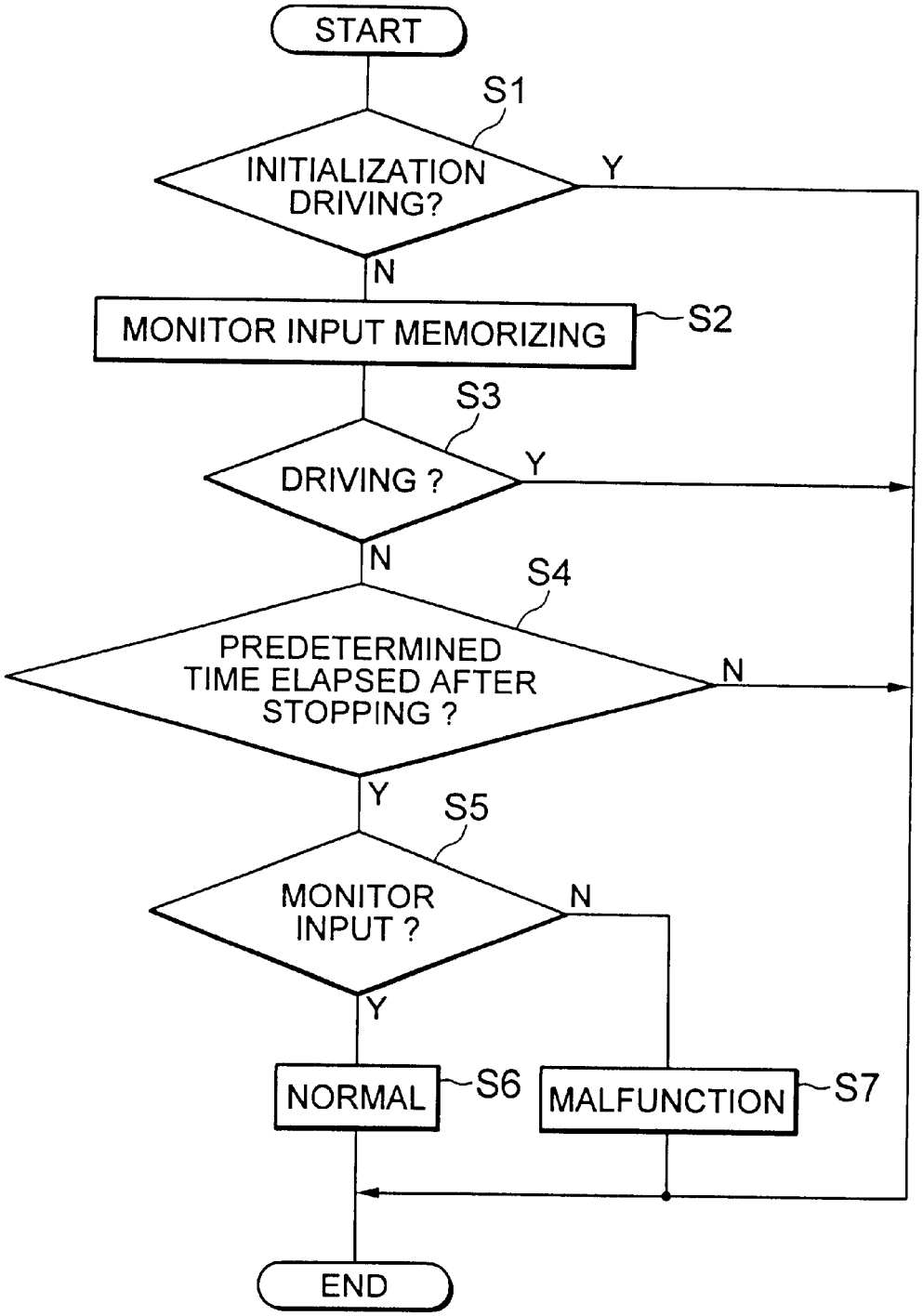
FIG. 6 is an operational flow-chart of malfunction detecting means for the EGR stepping motor in the engine controller 8 shown in FIG. 5.

FIG. 5 is a functional block diagram of an engine controller 8 according to a second embodiment shown in FIG. 1, and FIG. 6 shows an operational flow-chart of malfunction detecting means for the EGR stepping motor 804 in the engine controller 8 shown in FIG. 5.

Operations of the hardware circuits shown in FIG. 1 are the same as those in the first embodiment. Next, operations of the malfunction detecting means for the EGR stepping motor 804 will be described with reference to FIGS. 5 and 6. In this embodiment, malfunction detecting for the EGR stepping motor is carried out during the operation of the engine. In the malfunction detecting means for the EGR stepping motor 804, first, it is confirmed at Step S1 shown in FIG. 6 that initialization of the EGR valve 12 has been completed (detecting means for completion of the initialization 804*a* shown in FIG. 5); then when the EGR valve 12 is driven in association with operating conditions of the engine so that monitor input is generated, the monitor input is memorized at Step S2 (monitor input memorizing means 804*b*) by placing a plug in RAM 8*c* (see FIG. 1), for example; driving completion of the EGR valve 12 is confirmed at Step S3 (driving completion detecting means 804*c*); a predetermined time elapsed after the stop of the EGR valve 12 is confirmed at Step S4 (driving stop detecting means 804*d*); it is detected at Step S5 whether the monitor is input during the preceding driving (monitor input detecting means 804*e*); and it is determined to be normal at Step S6 when the monitor is input at Step S5, and when the monitor is not input, it is determined that there is wire breaking at Step S7 (malfunction determining means 804*f*).

In addition, it can be obtained that the state is not initialization driving in the detecting means for completion of the initialization 804*a*, the state that the EGR valve 12 has been driven in the driving completion detecting means 804*c*, and the state that a predetermined time elapsed after the driving is stopped in the driving stop detecting means 804*d* from the common controlling information of the entire engine (for example, the controlling command or signal to the EGR valve 12) generated by the engine controlling means 801 (see FIG. 3) and the output of the clock generator 8*d*, etc.

According to the present invention as described above, in order to determine the presence of wire breaks in excitation coils of the EGR stepping motor, there is provided a malfunction-detecting device for an EGR stepping motor comprising a driving-signal monitoring circuit which monitors a voltage surge as a monitoring signal, the voltage surge being generated by turning off a switching element for driving each of the excitation coils so as to cause self induction in the excitation coil, thereby obtaining a malfunction-detecting device for an EGR stepping motor having a simple circuit structure.

A malfunction-detecting device may further comprise malfunction detecting means of the EGR stepping motor for counting the number of monitoring inputs to the driving-signal monitoring circuit during initialization driving of the EGR stepping motor so as to determine the presence of wire breaks in the excitation coils when the number counted is less than the number of times the coils are driven. With these features, since malfunction detecting is performed during the initialization driving of the EGR valve, that is of the EGR stepping motor running at a slow speed, the monitor input of the driving-signal monitoring circuit can be precisely detected, thereby enabling a malfunction to be precisely detected.

The malfunction detecting means of the EGR stepping motor may determine the number of phases having wire breaks in the excitation coils by the number of counts of monitoring inputs to the driving-signal monitoring circuit during the initialization driving. With these features, more detailed information about malfunction detecting can be obtained.

The malfunction detecting means of the EGR stepping motor may comprise: initialization driving detecting means for detecting that an EGR valve is undergoing initialization driving; driving-pattern change detecting means for detecting a change in the driving pattern of the EGR valve; monitor input detecting means for detecting the monitor input from the driving-signal monitoring circuit; count addition means for adding one count every one monitor input while repeating above-mentioned confirmations until completion of the initialization; and malfunction state determining means for determining the excitation coils are normal or the number of phases having wire breaks therein by classifying counted values in association with the number of phases of the stepping motor. With these features, the simple structure of the device can determine whether excitation coils are normal or not, and can also determine even the number of phases having wire breaks when having breaks.

A malfunction-detecting device may further comprise malfunction detecting means of the EGR stepping motor for determining wire breaks in the EGR stepping motor by recognizing that a monitor input of driving signals is not input in the preceding driving state when the EGR stepping motor is stopped after it was driven corresponding to operational conditions of an engine. With these features, a simple structure can detect the malfunction of the EGR stepping motor during the engine operation, that is the vehicle running.

A malfunction-detecting device may further comprise: initialization-completion detecting means for detecting that initialization of an EGR valve has been completed; monitor input memorizing means for memorizing monitor input when the monitor input was generated by the driving of the EGR valve corresponding to operational conditions of an engine; driving completion detecting means for detecting completion of driving of the EGR valve when it was driven; driving stop detecting means for detecting a predetermined time elapsed after the stop of the EGR valve; monitor input detecting means for detecting whether monitor input is generated to the driving-signal monitoring circuit or not; and malfunction determining means for determining whether the excitation coils being normal or having wire breaks by examining the presence of the monitor input. With these features, a simple structure can detect the malfunction of the EGR stepping motor during the engine operation, that is the vehicle running.

What is claimed is:

1. A malfunction-detecting device for an EGR stepping motor, the device comprising a driving-signal monitoring circuit which monitors a voltage surge as a monitoring signal, wherein in order to determine the presence of wire breaks in excitation coils of the EGR stepping motor, the voltage surge is generated by turning off a switching element for driving each of the excitation coils so as to cause self induction in the excitation coil.

2. A malfunction-detecting device according to claim 1, further comprising malfunction detecting means of the EGR stepping motor for counting the number of monitoring inputs to the driving-signal monitoring circuit during initialization driving of the EGR stepping motor so as to determine the presence of wire breaks in the excitation coils when the number counted is less than the number of times the coils are driven.

3. A malfunction-detecting device according to claim 2, wherein the malfunction detecting means of the EGR stepping motor determines the number of phases having wire breaks in the excitation coils by the number of counts of the monitoring inputs to the driving-signal monitoring circuit during the initialization driving.

4. A malfunction-detecting device according to claim 3, wherein the malfunction detecting means of the EGR stepping motor comprises:

initialization driving detecting means for detecting that an EGR valve is undergoing initialization driving;

driving-pattern change detecting means for detecting a change in the driving pattern of the EGR valve;

monitor input detecting means for detecting the monitor input from the driving-signal monitoring circuit;

count addition means for adding one count for every monitor input while repeating said detection by the initialization driving detecting means, the driving-pattern change detecting means, and the monitor input detecting means until completion of the initialization; and malfunction state determining means for determining whether the excitation coils are normal and if not normal, the number of phases having wire breaks therein by classifying counted values in association with the number of phases of the stepping motor.

5. A malfunction-detecting device according to claim 1, further comprising malfunction detecting means of the EGR stepping motor for detecting wire breaks in the EGR stepping motor by recognizing that a monitor input of driving signals is not input in the preceding driving state when the EGR stepping motor is stopped after it was driven corresponding to operational conditions of an engine.

6. A malfunction-detecting device according to claim 5, further comprising:

initialization-completion detecting means for detecting that initialization of an EGR valve has been completed;

monitor input memorizing means for memorizing monitor input when the monitor input was generated by the driving of the EGR valve corresponding to operational conditions of an engine;

driving-completion detecting means for detecting completion of driving of the EGR valve when it was driven;

driving-stop detecting means for detecting a predetermined time elapsed after stopping of the EGR valve;

monitor input detecting means for detecting whether monitor input is generated to the driving-signal monitoring circuit; and malfunction determining means for determining whether the excitation coils are normal or have wire breaks by examining the presence of the monitor input.

* * * * *